US007343848B2

(12) United States Patent
Maher et al.

(10) Patent No.: US 7,343,848 B2
(45) Date of Patent: Mar. 18, 2008

(54) SELF-VACUUM ARRANGEMENT FOR PNEUMATIC EQUIPMENT

(75) Inventors: Patrick Maher, Highlands Ranch, CO (US); Jeffrey S. Stephens, Lakewood, CO (US)

(73) Assignee: Norgren, Inc., Littleton, CO (US)

( * ) Notice: Subject to any disclaimer, the term of this patent is extended or adjusted under 35 U.S.C. 154(b) by 70 days.

(21) Appl. No.: 11/385,964

(22) Filed: Mar. 21, 2006

(65) Prior Publication Data

US 2007/0221057 A1 Sep. 27, 2007

(51) Int. Cl.
*F01B 31/00* (2006.01)

(52) U.S. Cl. ..... 92/86; 92/87; 60/412

(58) Field of Classification Search ..... 60/412; 92/86, 87; 417/76, 77
See application file for complete search history.

(56) References Cited

U.S. PATENT DOCUMENTS 2,625,797 A * 1/1953 Poort et al. ..... 417/76
2,707,021 A * 4/1955 Harris ..... 417/76
4,245,844 A * 1/1981 Pohl et al. ..... 277/432
4,621,981 A 11/1986 Lorett
5,031,509 A * 7/1991 Cowan ..... 92/86
5,188,411 A 2/1993 Golden
5,622,203 A 4/1997 Givler

FOREIGN PATENT DOCUMENTS

EP 0334655 A 9/1989
FR 2695437 A 3/1994
GB 2044370 A 10/1980
GB 2316474 A 2/1998

* cited by examiner

*Primary Examiner*—Michael Leslie
(74) *Attorney, Agent, or Firm*—The Ollila Law Group LLC

(57) ABSTRACT

A self-vacuum arrangement for pneumatic equipment is provided. A Venturi device having first and second ports and a central tap is provided. A first check valve having a first port operably coupled with the central tap of the Venturi device is configured to prevent pneumatic flow from the central tap through the first check valve. Optionally included is a second valve having a first port operably coupled with the first port of the Venturi device, and a second port operably coupled with the second port of the Venturi device.

34 Claims, 7 Drawing Sheets

SELF-VACUUM ARRANGEMENT FOR PNEUMATIC EQUIPMENT

FIELD OF THE INVENTION

Aspects of the invention relate generally to pneumatic equipment, and more particularly to a self-vacuum arrangement for a pneumatic actuator.

BACKGROUND OF THE INVENTION

Many industrial applications employ mechanical machinery that utilizes compressed air as a source of power. The use of such pneumatic equipment provides several potential advantages. For example, since the air compressor providing the power may be coupled with the associated pneumatic equipment by way of long air hoses or other conduits, the compressor may be located at a physically remote area, thus resulting in reduced levels of particulate emissions, noise, and other environmental maladies in the immediate area of the pneumatic equipment. Also, with a single compressor possibly powering many different pieces of pneumatic equipment, the overall space consumed by the equipment and the power source combined may be reduced over electrical and other forms of machinery.

Movement of pneumatic equipment is typically accomplished by way of a pneumatic actuator. FIG. 1 provides a simplified cross-sectional diagram of a typical double-acting, single-rod pneumatic actuator 1. In this example, a hollow cylinder 2, capped at each end by an end cap 4 and a head cap 6, provides a vessel into which compressed air may be pumped by way of pneumatic ports 8, 10 and pneumatic channels 12, 14 defined by the caps 4, 6. Within the cylinder 2 resides a piston 16 attached to a rod 18, with the rod 18 extending through an orifice 20 of the head cap 6. Generally, the orifice 20 through which the rod 18 extends distinguishes the head cap 6 from the end cap 4. The end 19 of the rod 18 extending from the head cap 6 may define any of a number of features, such as a set of threads, a square stud, a hole, or the like, to which mechanical machinery may be attached.

In the particular example of FIG. 1, movement of the attached machinery is accomplished by compressed air pumped into the cylinder 2 through either cap 4, 6 via the cylinder ports 8, 10 and channels 12, 14. In response, the piston 16 is moved along the long axis of the cylinder 2, which in turn causes the rod 18 to extend from or retract into the cylinder 2. For specifically, when air is compressed into the cylinder 2 by way of the pneumatic port 8 and channel 12 of the end cap 4, the piston 16 is forced toward the head cap 6, thus causing the rod 18 to extend from the head cap 6. Conversely, if air is forced into the cylinder 2 via the pneumatic port 10 and channel 14 of the head cap 6, the piston 16 is forced back toward the end cap 4, thus forcing the rod 18 to retract back into the cylinder 2.

To provide a substantially airtight compartment formed by the cylinder 2 in the presence of the moving piston 16 and rod 18, a pair of piston seals 22 and a rod seal 24 are typically utilized. In alternative examples, a single piston seal 22 may be employed. The piston seals 22 are essentially rings made of a long-wearing material which prevent compressed air from passing between the sides of the piston 16 and the cylinder 2, thus allowing compressed air entering either the end cap 4 or the head cap 6 to impart maximum air pressure, and thus force, to move the piston 16. Similarly, the rod seal 24 typically is an annular-shaped member sized to allow the rod 18 to fit closely therethrough, thus substantially preventing compressed air from the cylinder 2 from escaping between the rod 18 and the orifice 20 of the head cap 6, thus limiting loss of pneumatic pressure inside the cylinder 2.

In addition, a rod wiper 26 is often included within the orifice 20 of the head cap 6 between the end of the rod 18 and the rod seal 24. Like the rod seal 24, the rod wiper 26 typically is annular in shape so that the rod 18 may slide therethrough. The primary function of the rod wiper 26 is to prevent dust particles and other contaminants from entering and exiting the orifice 20 and the cylinder 2, which could adversely affect the operation and longevity of the actuator 1. Each time the rod 18 is retracted into the cylinder 2, the rod wiper 26 wipes contaminants from the surface of the rod 18, thus preventing the contaminants from reaching the rod seal 24 and other components of the actuator 1.

In contrast to the double-acting, single-rod pneumatic actuator 1 of FIG. 1, several alternative arrangements for pneumatic actuators are also common. For example, single-acting actuators, in which a piston is biased toward one end of a cylinder by a spring, employ compressed air to counteract the force of the spring, thereby requiring only a single cylinder port to allow movement of the piston in both directions along the cylinder. Also, double-rod actuators, as the name implies, employ two rods, each of which is attached to an opposing side of a piston. Thus, one rod extends further from the cylinder while the other is retracted when the piston moves from one end of a cylinder to the other. In addition, single- and double-rod actuators may each be configured as single- or double-acting actuators. Despite the differences among these and other pneumatic actuator arrangements, however, many of the same components depicted in FIG. 1, including the rod 18, rod seal 24 and rod wiper 26, are employed regardless of the arrangement.

One popular environment for the use of pneumatic actuators is a "clean room," often associated with the manufacture of integrated circuits (ICs). As the name implies, clean rooms provide an environment of greatly reduced levels of dust particles and other contaminants. Production of ICs and other high-technology products normally requires a clean room environment to prevent contamination, which increases product failure rates and reduces production yield.

The use of pneumatic actuators has long been favored for supplying movement for machinery in a clean room due to their low level of negative impact on their local environment, as discussed above. However, as IC geometries continue to be reduced, requiring increased levels of cleanliness during manufacturing, even miniscule levels of foreign material that may be produced during the operation of a pneumatic actuator have become a concern. Using the actuator 1 of FIG. 1 as an example, small amounts of oil or grease commonly used for lubrication within the actuator 1, as well as small particulate matter produced under normal operation of the actuator 1, may escape through the orifice 20 of the head cap 6, past the rod seal 24 and the rod wiper 26 due to the movement of the rod 18 in and out of the cylinder 2. Once such a contaminant has passed the rod wiper 26, the rod wiper 26 may function to sweep the contaminant further down the rod 18, thus introducing small amounts of the contaminant into the clean room environment.

One pneumatic actuator 1*a* which has been devised in an effort to reduce the contamination is shown in FIG. 2. In addition to the components previously discussed in conjunction with the actuator 1 of FIG. 1, the actuator 1*a* of FIG. 2 also employs an external vacuum system 30 coupled with the orifice 20 in a void 25 between the rod seal 24 and the rod wiper 26 by way of a vacuum channel 28. The vacuum system 30 operates to remove most contaminants from the void 25 prior to encountering the rod wiper 26, thus reducing the levels of contaminants expelled from the actuator 1*a*. Unfortunately, supplying the external vacuum system 30 adds significant cost and complexity to an already expensive clean room environment, while typically consuming valuable space.

SUMMARY OF THE INVENTION

One embodiment of the present invention provides a self-vacuum arrangement for pneumatic equipment, such as a pneumatic actuator. A Venturi device having a first port, second port, and central tap is provided. A first check valve having a first port operably coupled with the central tap of the Venturi device is configured to prevent pneumatic flow from the central tap through the first check valve. Optionally, a second check valve having a first port operably coupled with the first port of the Venturi device and a second port operably coupled with the second port of the Venturi device may be included.

In another embodiment of the invention, a self-vacuum arrangement for a pneumatic actuator is provided which includes means for creating a vacuum in a void associated with the pneumatic actuator when a gas is forced from an interior of a cylinder of the actuator to a pneumatic port of the actuator. Also provided are means for preventing pneumatic flow into the void from the vacuum-creating means. Optionally, means for directing pneumatic flow between the pneumatic port and the interior of the cylinder is provided. More specifically, pneumatic flow from the pneumatic port to the interior of the cylinder circumvents the vacuum-creating means, and pneumatic flow from the interior of the cylinder to the pneumatic port is forced through the vacuum-creating means.

Further embodiments of the invention provide a method for creating a vacuum inside a void associated with the pneumatic actuator. Pneumatic flow is directed from an interior of a cylinder of the pneumatic actuator to a pneumatic port of the pneumatic actuator through a Venturi device pneumatically coupled to the void to create a vacuum in the void. Also, pneumatic flow from the Venturi device to the void is inhibited. Optionally, pneumatic flow from the pneumatic port to the interior of the cylinder may be directed to circumvent the Venturi device.

Additional embodiments and advantages of the present invention will be realized by those skilled in the art upon perusal of the following detailed description, taken in conjunction with the accompanying drawings.

DETAILED DESCRIPTION OF THE INVENTION

Figure 3:
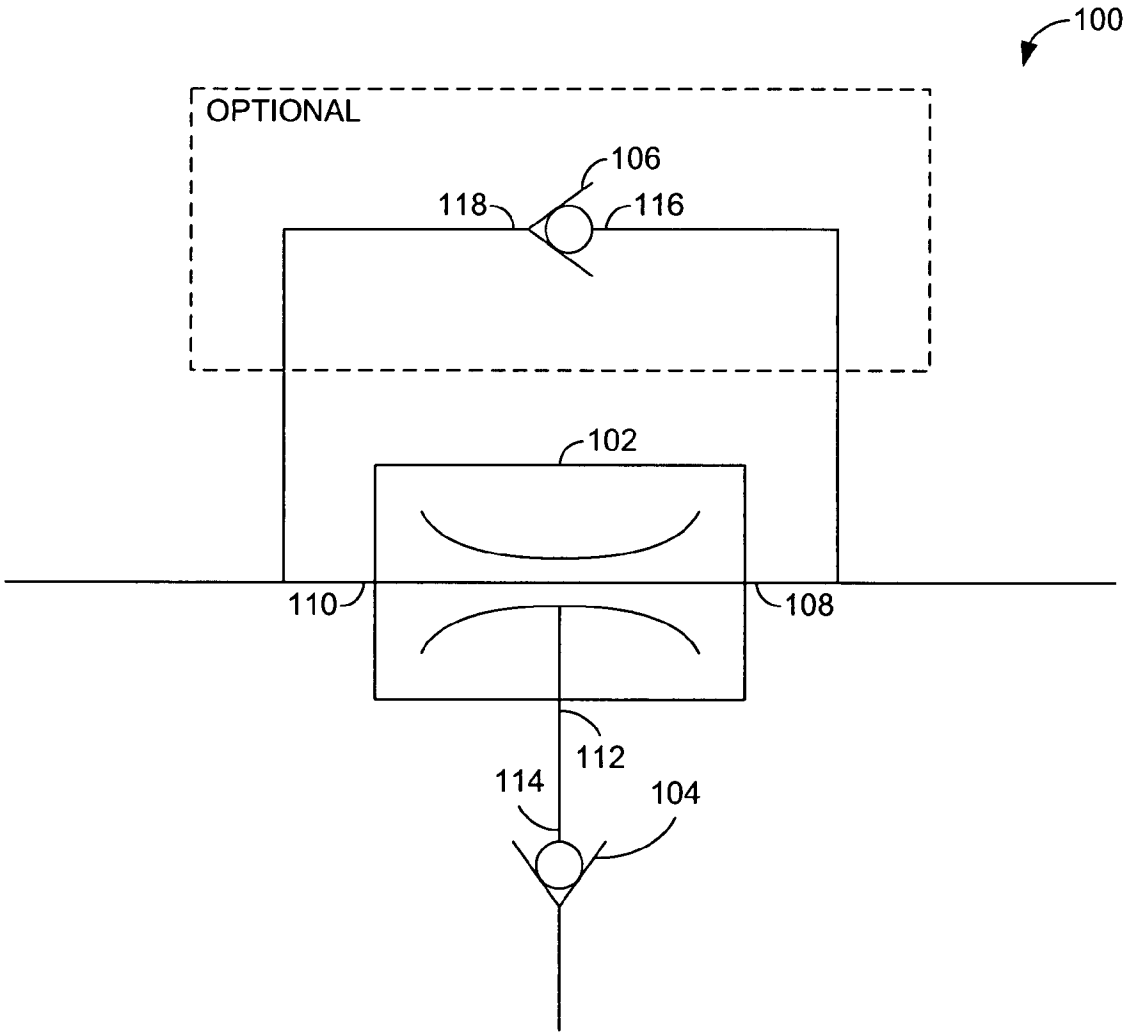
FIG. 3 is a pneumatic schematic diagram of a self-vacuum arrangement according to an embodiment of the invention.

FIG. 3 depicts a pneumatic schematic diagram of a self-vacuum arrangement 100 according to an embodiment of the invention. Generally, the arrangement 100 includes a Venturi device 102 having a first port 108, a second port 110, and a central tap 112. Operably coupled with the central tap 112 is a first port 114 of a first check valve 104 configured to prevent pneumatic flow from the central tap 112 of the Venturi device 102 through the first check valve 104. Optionally, in another embodiment of the invention, a second check valve 106 having a first port 116 and a second port 118 is operably coupled with the Venturi device 102 such that the first port 116 of the second check valve 106 is coupled with the first port 108 of the Venturi device 102, while the second port 118 of the second check valve 106 is coupled with the second port 110 of the Venturi device 102.

Figure 4:
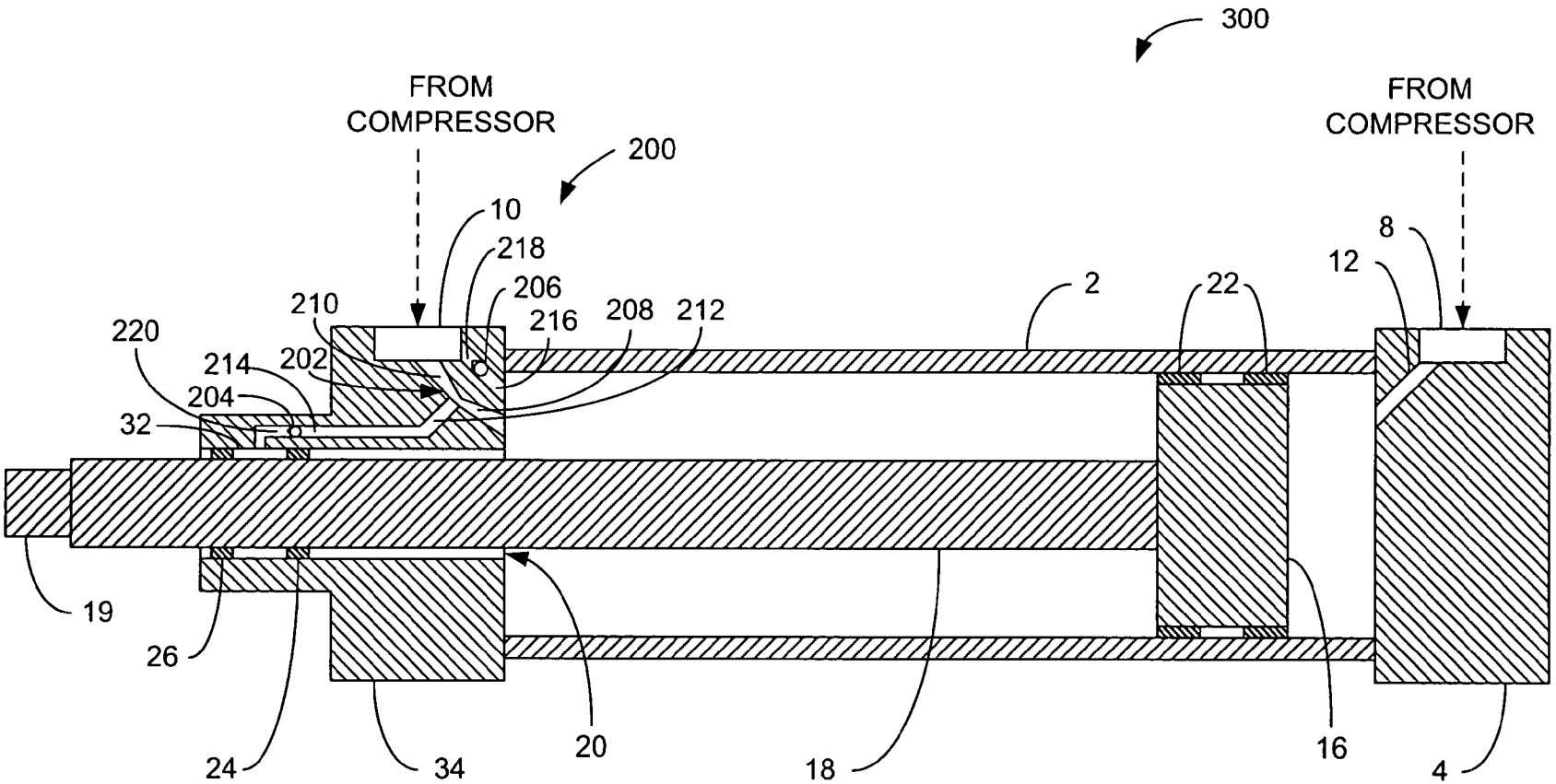
FIG. 4 is a simplified cross-sectional view of a double-acting, single-rod pneumatic actuator employing the self-vacuum arrangement of FIG. 3 according to an embodiment of the invention.

One embodiment of the invention, shown in the context of a pneumatic actuator 300 as shown in FIG. 4, is a self-vacuum arrangement 200 employing a Venturi device 202, a first check valve 204 and a second check valve 206. A first port 208 of the Venturi device 202 and a first port 216 of the second check valve 206 are coupled with the interior of the cylinder 2 of the actuator 300, while a second port 210 of the Venturi device 202 and a second port 218 of the second check valve 206 are coupled with a pneumatic port 10 of the actuator 300. Also, a first port 214 of the first check valve 204 is coupled with the central tap 212 of the Venturi device 202. In turn, a second port 220 of the first check valve 204 is coupled with a void 32 within the pneumatic actuator 300. FIG. 4 provides an approximate representation of one possible embodiment of the arrangement 200. Thus, FIG. 4 is not intended to provide exact placements, measurements or proportions of the various components of the arrangement 200.

In this configuration, the Venturi device 202 creates a vacuum in the void 32 of the pneumatic actuator 300 when air is forced from the interior of the cylinder 2 to the pneumatic port 10 of a head cap 34. In this context, the vacuum is not an absolute vacuum, but a reduction in pressure tending to cause removal of matter from the void 32. In the particular example of FIG. 4, the void 32 is a space within the orifice 20 of the head cap 34 between the rod seal 24 and the rod wiper 26. In one embodiment, the vacuum in the void 32 draws contaminants, such as oil, grease, and particulate matter, from the void 32 toward the pneumatic port 10. This action helps divert contaminants away from the rod wiper 26, thus preventing their escape outside of the head cap 34 on the rod 18, thereby reducing potential contamination of the environment surrounding the actuator 300.

The Venturi device 202 operates according to the Venturi effect, or alternatively, the Bernoulli Principle. More specifically, pneumatic flow between the first port 208 and second port 210 of the Venturi device tends to lower pneumatic pressure at the central tap 212 compared to that at either the first port 208 or the second port 210. In one embodiment, the Venturi device 202 defines a tube-like configuration that narrows toward approximately the center. The ends of the configuration define the first port 208 and the second port 210. An aperture near the center of the Venturi device 202 defines the central tap 212. In alternative embodiments, the Venturi device 202 may be replaced by another structure that creates a vacuum at a port when airflow is provided through the structure.

The first and second check valves 204, 206 each may be any device or structure that permits pneumatic flow in one direction through the check valve 204, 206, but essentially prohibits any pneumatic flow in the opposing direction. In one embodiment, the check valves 204, 206 are ball-type valves. In an alternative embodiment, the check valves 204, 206 may be flexible flaps. Typically, the pneumatic actuator 300 employs air as the pneumatic medium. Thus, the check valves 204, 206 allow or prevent airflow within the actuator 300, depending on their configuration or orientation.

The first check valve 204, coupled between the Venturi device 202 and the void 32, prevents pneumatic flow into the void 32 from the Venturi device 202. Thus, airflow, along with any contaminants previously removed from the void 32, is substantially prevented from reentering the void 32. Such airflow may be possible, for example, when air is forced into the pneumatic port 10 in order to move the piston 16 from the head cap 34 toward the end cap 4. Without the first check valve 204, such airflow and contaminants may be forced past the rod wiper 26 external to the actuator 300 in some embodiments. Also, the first check valve 204 prevents pressurization of the void 32 from forcing any contaminants residing in the void 32 past the rod wiper 26. This scenario may occur when the piston 16 is forced toward the end cap 4, thus preventing further substantial airflow through the Venturi device 202.

The second check valve 206 directs airflow between the pneumatic port 10 and the interior of the cylinder 2. More specifically, the second check valve 206 is configured to direct airflow from the interior of the cylinder 2 through the Venturi device 202 to the pneumatic port 10, resulting from the piston 16 moving toward the head cap 34 by way of air forced into the interior of the cylinder 2 via the pneumatic port 8. Under these circumstances, the Venturi device 202 acts to create a vacuum at the central tap 212, and thus the void 32, so that contaminants in the void 32 may be drawn from the void 32, toward the Venturi device 202 and the pneumatic port 10.

Conversely, the second check valve 206 allows airflow from the pneumatic port 10 to the interior of the cylinder 2 to circumvent the Venturi device 202. In one embodiment, the second check valve 206 is configured to open quickly with little pressure into the pneumatic port 10 so that a greatly reduced amount of air passes through the Venturi device 202. As a result, pressure at the central tap 212, and consequently the void 32, is not appreciably reduced while air is being forced into the cylinder 2 via the pneumatic port 10. Thus, contaminants are substantially prevented from being drawn from the void 32 and injected back into the interior of the cylinder 2.

In alternative embodiments, the second check valve 206, along with its first port 216 and second port 218, may be eliminated. For example, the Venturi device 202 or other portions of the pneumatic actuator 300 may be configured in such a manner that air passing through the Venturi device 202 from its second port 210 to its first port 208 does not cause significant airflow from the void 32 toward the central tap 212.

While the self-vacuum arrangement 200 is shown in FIG. 4 as being incorporated within a body of the head cap 34, other related embodiments may employ a separate bushing or other structure within the head cap 34 for holding the various components of the arrangement 200. Also, in the case of a double-rod actuator, the arrangement 200 may be employed at each capped end of the actuator.

Figure 1:
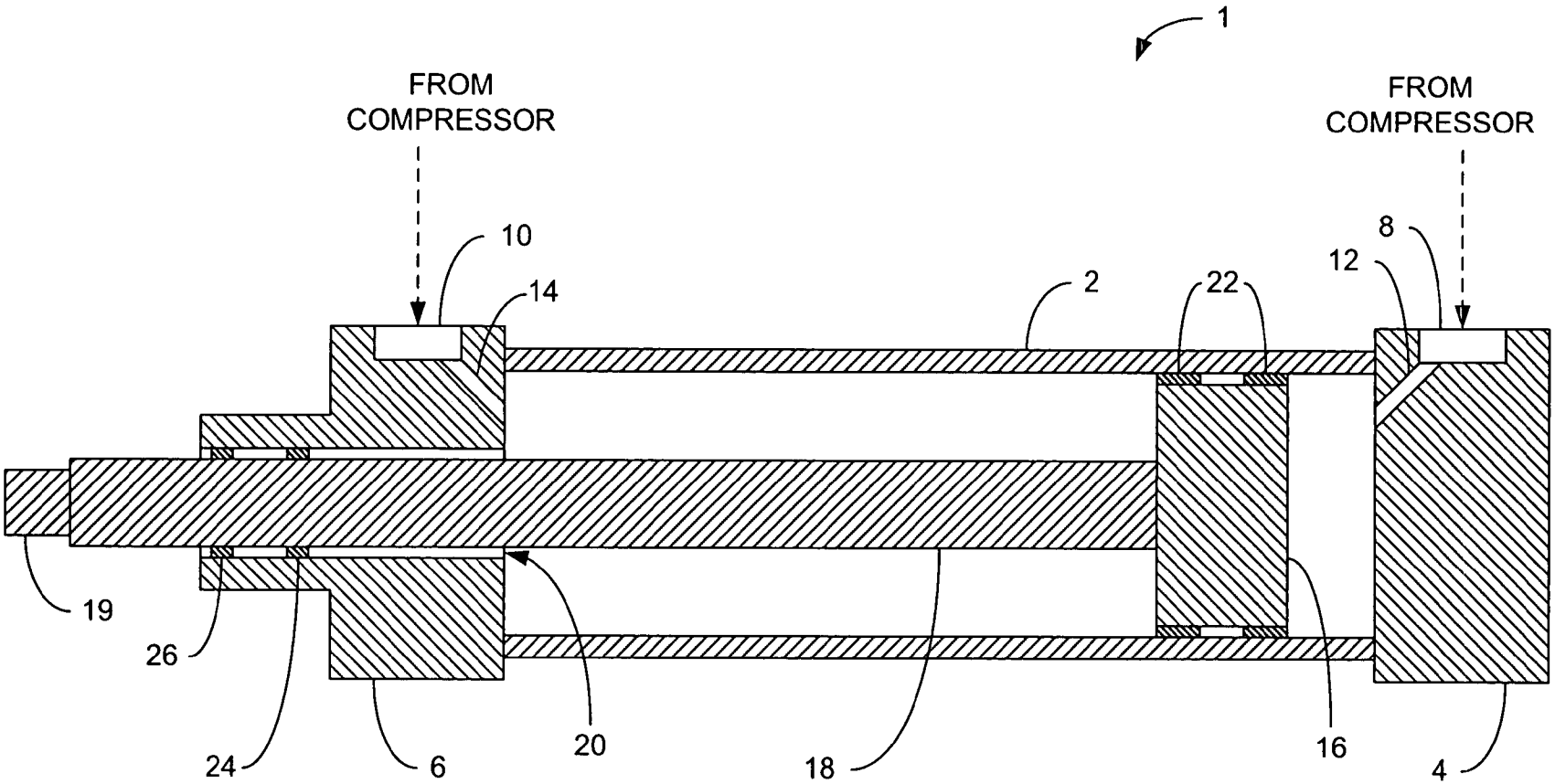
PRIOR ART FIG. 1
FIG. 1 is a simplified cross-sectional view of a double-acting, single-rod pneumatic actuator from the prior art.
Figure 5:
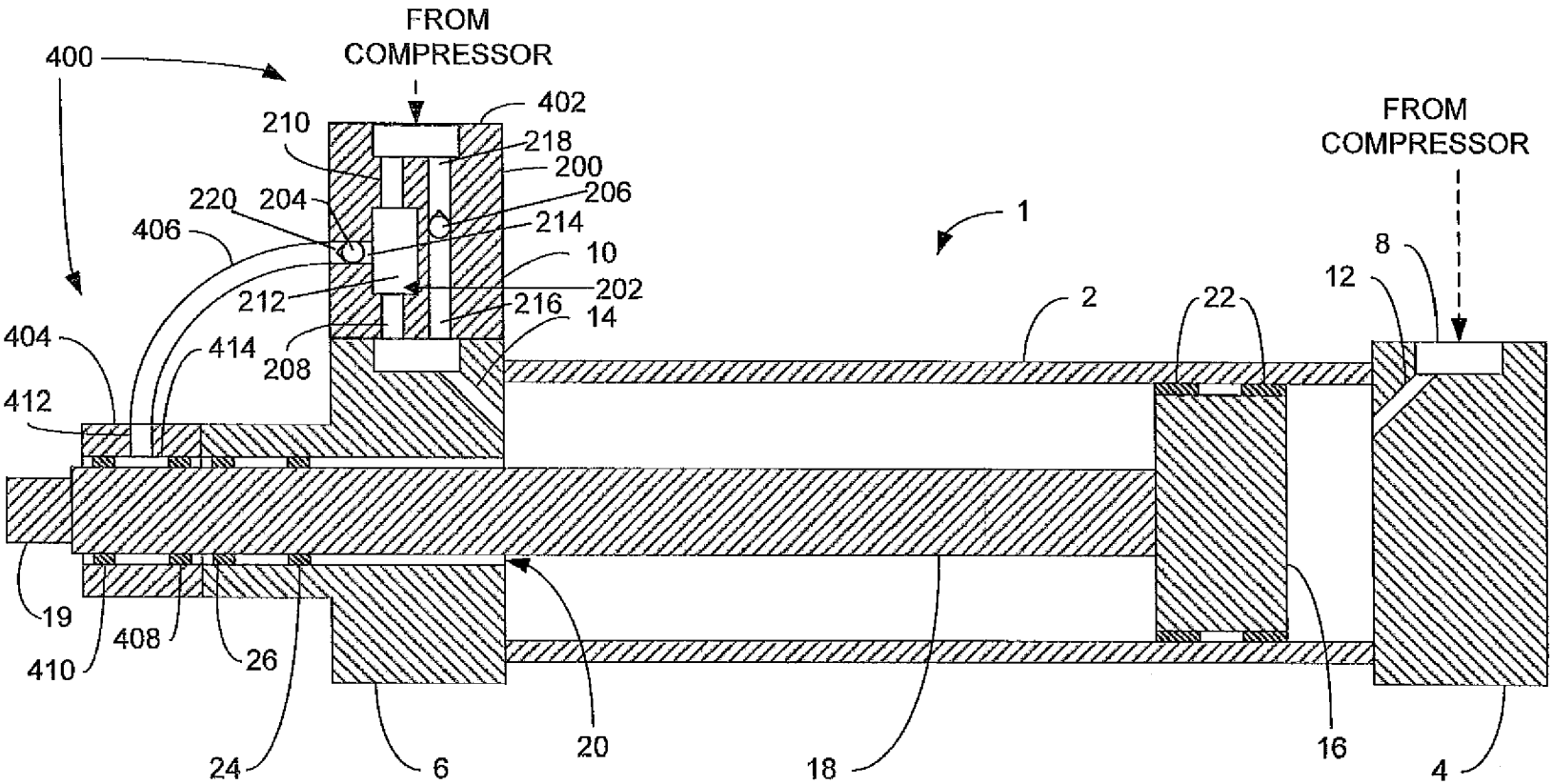
FIG. 5 is a simplified cross-sectional view of the double-acting, single-rod pneumatic actuator of FIG. 1 employing a pneumatic coupler and an external vacuum-generating cartridge according to an embodiment of the invention.

In alternative embodiments, the self-vacuum arrangement 200 may be employed as part of a structure externally connectable with a preexisting pneumatic actuator, such as the actuator 1 of FIG. 1, thus allowing use of legacy pneumatic actuators while protecting the environment external to the actuator 1 from contamination. FIG. 5 illustrates one example of the actuator 1, to which an external self-vacuum apparatus 400 is coupled. The external arrangement 400 includes a vacuum-generating cartridge 402 and a pneumatic coupler 404. The vacuum-generating cartridge 402 contains a self-vacuum arrangement, such as the self-vacuum arrangement 200 described above. In this particular example, the vacuum-generating cartridge 402 would be connected with the pneumatic port 10 of the head cap 6 so that air passing between a compressor and the head cap 6 would pass through the vacuum-generating cartridge 402, and thus the self-vacuum arrangement 200, by way of the first port 208 and the second port 210 of the enclosed Venturi device (not shown in FIG. 5). As described above, the self-vacuum arrangement 200 may or may not include the second check valve 206 and its first and second ports 216, 218.

The vacuum-generating cartridge 402 is also coupled by way of a hose 406 or other conduit to the pneumatic coupler 404. In the embodiment of FIG. 5, the hose 406 is coupled with the second port 220 of the first check valve 204 (not shown in FIG. 5), and a channel 412 of the pneumatic coupler 404 joining the hose 406 with a void 414 between seals 408, 410. The seals 408, 410 are employed by the pneumatic coupler 404 to pneumatically couple with the rod 18 while allowing the rod 18 its operating motion along its long axis.

In a fashion similar to that described above, the airflow resulting from the compressor moving the piston 16 within the cylinder 2 causes airflow from the void 414, through the channel 412 of the pneumatic coupler 404, and the hose 406 into the vacuum-generating cartridge 402. Contaminants that have bypassed the rod wiper 26 into the void 414 would thus be removed from the pneumatic coupler 404 via the hose 406 before reaching the external environment.

Figure 2:
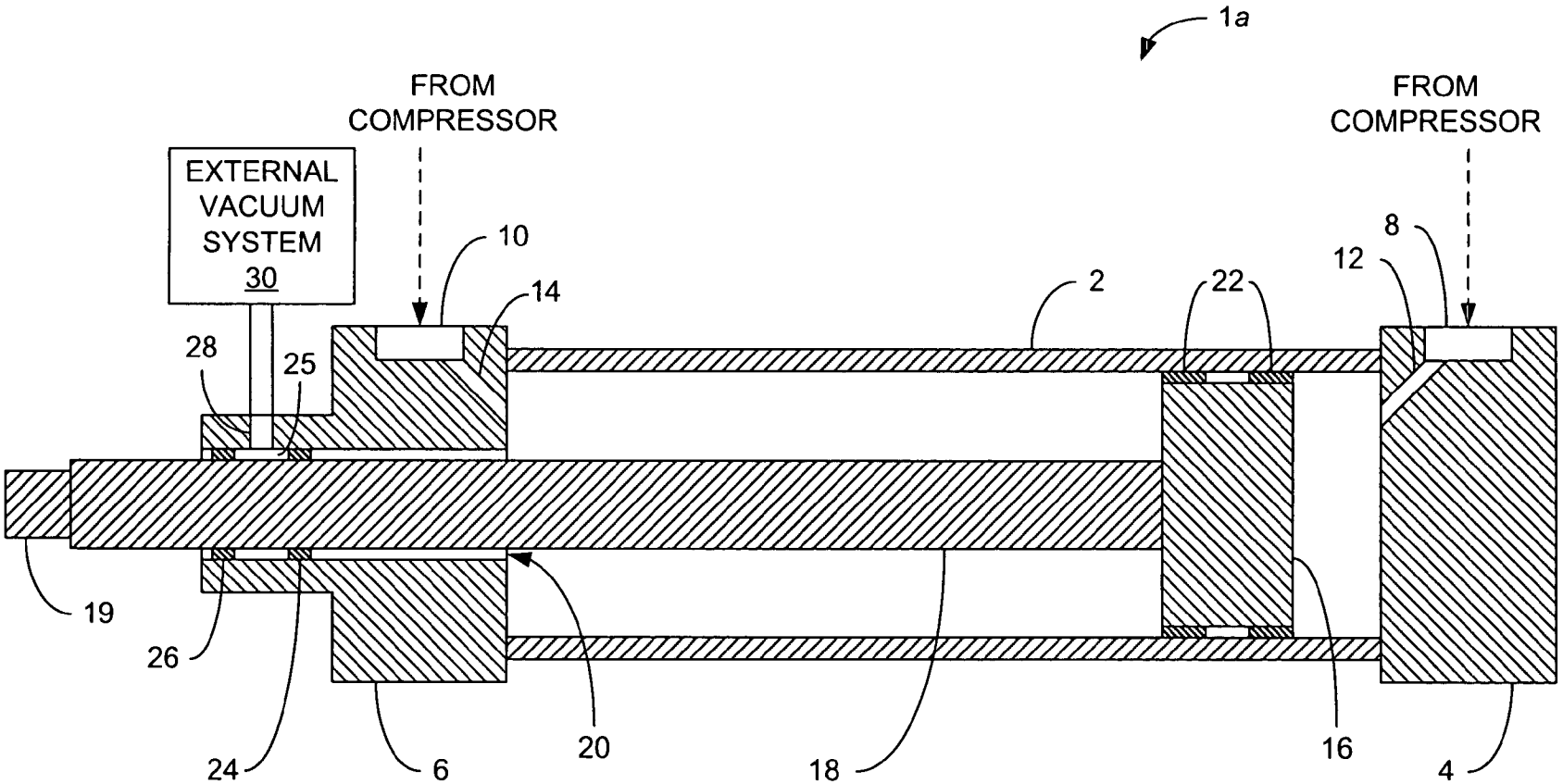
PRIOR ART FIG. 2
FIG. 2 is a simplified cross-sectional view of a double-acting, single-rod pneumatic actuator from the prior art employing an external vacuum system.
Figure 6:
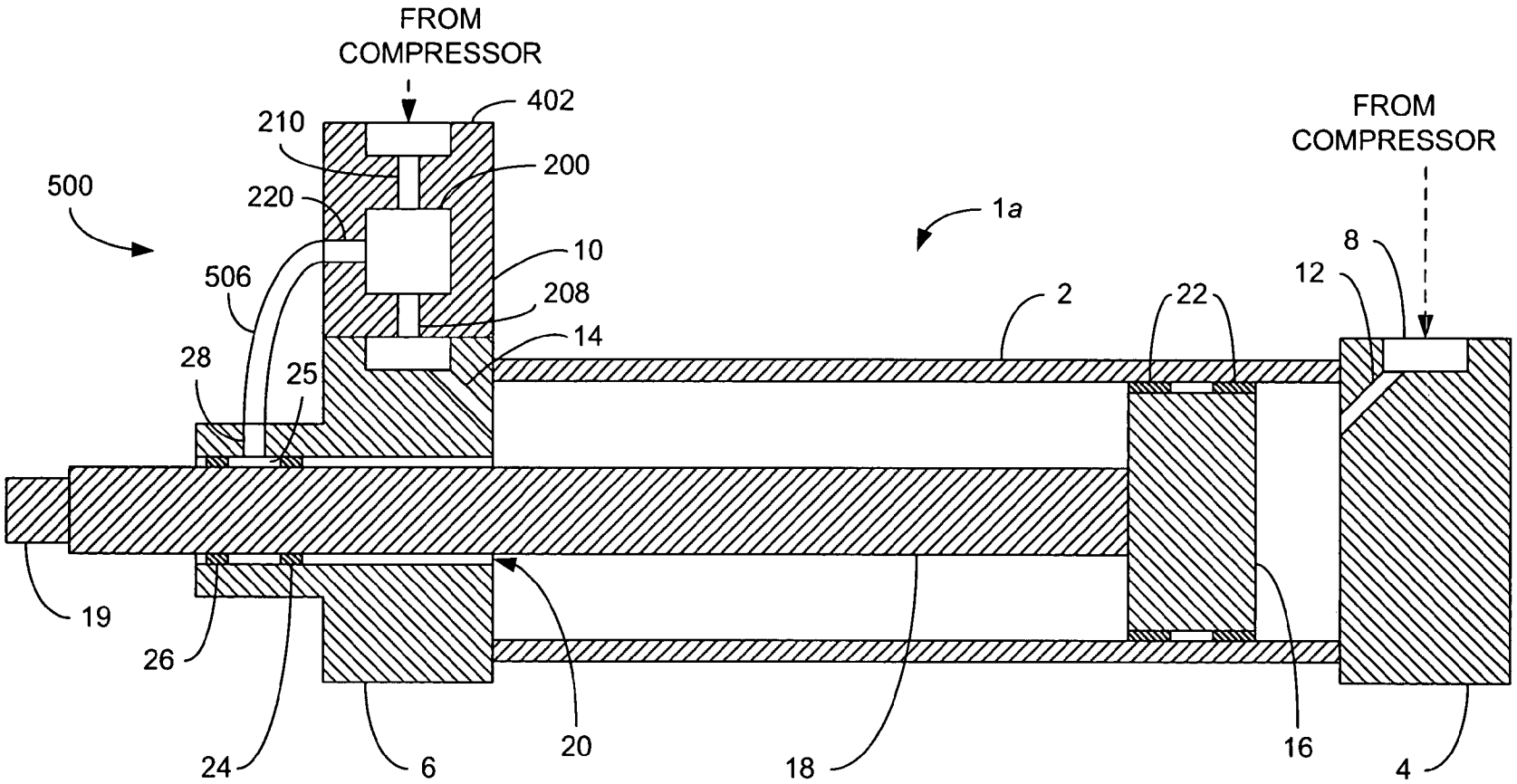
FIG. 6 is a simplified cross-sectional view of the double-acting, single-rod pneumatic actuator of FIG. 2 employing a vacuum-generating cartridge according to an embodiment of the invention.

In another external embodiment depicted in FIG. 6, a second external vacuum apparatus 500 includes the vacuum-generating cartridge 402 of FIG. 5 and a hose 506 or similar conduit. In this example, the vacuum-generating cartridge 402 is pneumatically coupled with a head cap 6 of the pneumatic actuator 1*a* of FIG. 2 configured to be connected with the external vacuum system 30 discussed earlier. To accomplish the vacuum function, the vacuum-generating cartridge 402 is coupled with the vacuum channel 28 of the head cap 6 by way of the hose 506. As a result, contaminants within the void 25 between the rod seal 24 and the rod wiper 26 will be removed via the channel 28 and the hose 506 to the vacuum-generating cartridge 402. As a result, the actuator 1*a* originally designed for use with the external vacuum system 30 may obtain similar benefits of contaminant removal with lower overall cost by utilizing the second external vacuum apparatus 500 in lieu of the vacuum system 30.

Figure 7:
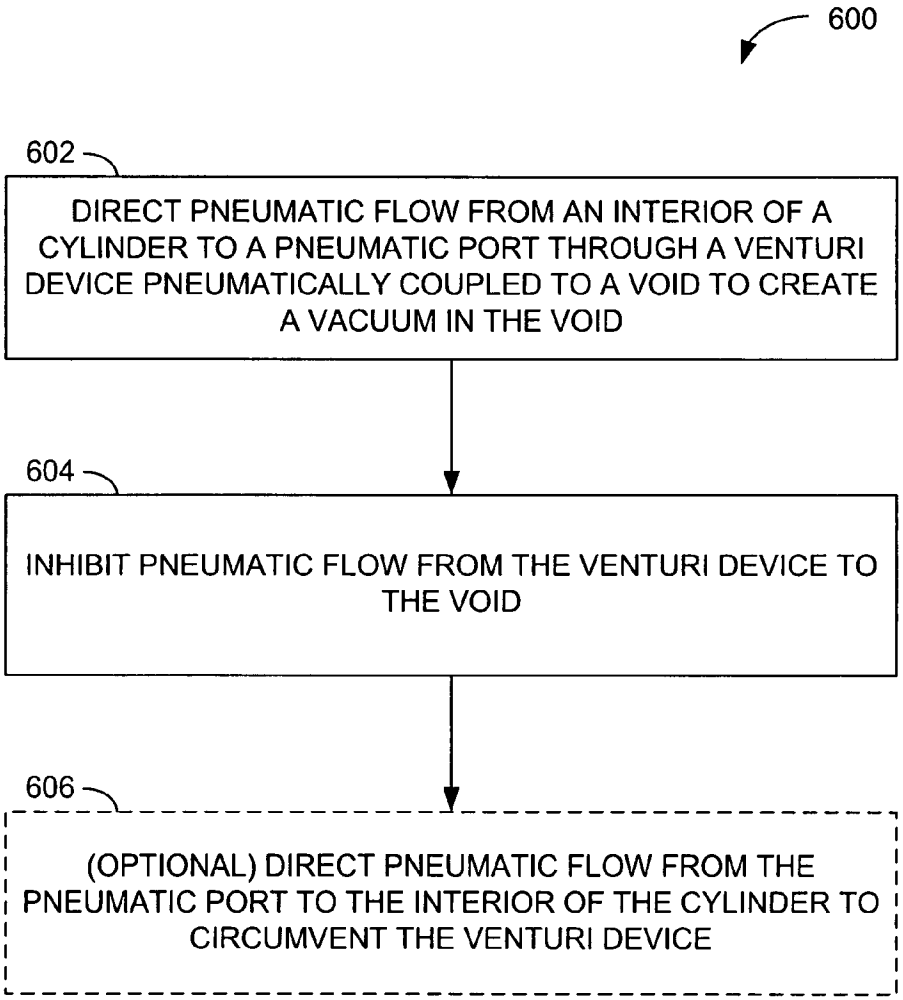
FIG. 7 is a flow chart of a method according to an embodiment of the invention for creating a vacuum inside a void associated with a pneumatic actuator.

In another embodiment of the invention, a method 600, depicted in the flow chart of FIG. 7, creates a vacuum inside a void of a pneumatic actuator. The method 600 includes directing pneumatic flow from an interior of a cylinder of the pneumatic actuator to a pneumatic port of the pneumatic actuator through a Venturi device pneumatically coupled to the void to create a vacuum in the void (operation 602). In addition, pneumatic flow from the Venturi device to the void is inhibited (operation 604). In one embodiment, the creation of the vacuum in the void, as promoted by the method, causes contaminants to be drawn from the void to the pneumatic port. Optionally, pneumatic flow from the pneumatic port to the interior of the cylinder is directed to circumvent the Venturi device (operation 606).

While several embodiments of the invention have been discussed herein, other embodiments encompassed within the scope of the invention are possible. For example, while embodiments of the invention as presented above involve the removal of contaminants from a void between a rod seal and a rod wiper of a pneumatic actuator, other areas of an actuator may benefit from use of the invention as well. Also, while embodiments of the present invention have discussed self-vacuum arrangements and methods specifically in conjunction with a pneumatic actuator, other types of pneumatic equipment may benefit from aspects of the various embodiments of the invention described herein. Further, aspects of one embodiment may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims.

What is claimed is:

1. A self-vacuum arrangement, comprising:

a head cap for a pneumatic actuator, the head cap comprising:

a Venturi device having a first port, a second port, and a central tap; and a first check valve having a first port operably coupled with the central tap of the Venturi device and configured to prevent pneumatic flow from the central tap through the first check valve.

2. The self-vacuum arrangement of claim 1, further comprising a second check valve having a first port operably coupled with the first port of the Venturi device and a second port operably coupled with the second port of the Venturi device.

3. The self-vacuum arrangement of claim 2, wherein the second check valve prevents pneumatic flow through the second check valve from the first port of the second check valve to the second port of the second check valve.

4. The self-vacuum arrangement of claim 3, wherein the Venturi device is configured to draw pneumatic flow into the central tap of the Venturi device through the first check valve when pneumatic flow occurs through the Venturi device from the first port of the Venturi device to the second port of the Venturi device.

5. The self-vacuum arrangement of claim 4, wherein the first port of the Venturi device and the first port of the second check valve are pneumatically coupled with an interior of a cylinder of a pneumatic actuator, the second port of the Venturi device and the second port of the second check valve are pneumatically coupled with a pneumatic port of the pneumatic actuator, and a second port of the first check valve is pneumatically coupled with a void associated with the pneumatic actuator.

6. The self-vacuum arrangement of claim 5, wherein the void is a space between a rod seal and a rod wiper of the pneumatic actuator.

7. The self-vacuum arrangement of claim 5, wherein the void is a space between a first seal and a second seal of a pneumatic coupler attached to the pneumatic actuator.

8. The self-vacuum arrangement of claim 5, wherein pneumatic flow occurs through the Venturi device from the first port of the Venturi device to the second port of the Venturi device when a piston moves within the interior of the cylinder of the pneumatic actuator.

9. The self-vacuum arrangement of claim 2, wherein the first and second check valves comprise ball valves.

10. A pneumatic actuator comprising the self-vacuum arrangement of claim 1.

11. A self-vacuum arrangement, comprising:

a vacuum-generating cartridge attachable to a pneumatic actuator, the vacuum-generating cartridge comprising:

a Venturi device having a first port, a second port, and a central tap; and a first check valve having a first port operably coupled with the central tap of the Venturi device and configured to prevent pneumatic flow from the central tap through the first check valve.

12. The self-vacuum arrangement of claim 11, further comprising a second check valve having a first port operably coupled with the first port of the Venturi device and a second port operably coupled with the second port of the Venturi device.

13. The self-vacuum arrangement of claim 12, wherein the second check valve prevents pneumatic flow through the second check valve from the first port of the second check valve to the second port of the second check valve.

14. The self-vacuum arrangement of claim 13, wherein the Venturi device is configured to draw pneumatic flow into the central tap of the Venturi device through the first check valve when pneumatic flow occurs through the Venturi device from the first port of the Venturi device to the second port of the Venturi device.

15. The self-vacuum arrangement of claim 14, wherein the first port of the Venturi device and the first port of the second check valve are pneumatically coupled with an interior of a cylinder of a pneumatic actuator, the second port of the Venturi device and the second port of the second check valve are pneumatically coupled with a pneumatic port of the pneumatic actuator, and a second port of the first check valve is pneumatically coupled with a void associated with the pneumatic actuator.

16. The self-vacuum arrangement of claim 15, wherein the void is a space between a rod seal and a rod wiper of the pneumatic actuator.

17. The self-vacuum arrangement of claim 15, wherein the void is a space between a first seal and a second seal of a pneumatic coupler attached to the pneumatic actuator.

18. The self-vacuum, arrangement of claim 15, wherein pneumatic flow occurs through the Venturi device from the first port of the Venturi device to the second port of the Venturi device when a piston moves within the interior of the cylinder of the pneumatic actuator.

19. The self-vacuum arrangement of claim 12, wherein the first and second check valves comprise ball valves.

20. A pneumatic actuator comprising the self-vacuum arrangement of claim 11.

21. A self vacuum arrangement for a pneumatic actuator, comprising:

means for creating a vacuum in a void associated with the pneumatic actuator when a gas is forced from an interior of a cylinder of the pneumatic actuator to a pneumatic port of the pneumatic actuator;

means for preventing pneumatic flow into the void from the vacuum-creating means; and means for directing pneumatic flow between the pneumatic port and the interior of the cylinder, wherein pneumatic flow from the pneumatic port to the interior of the cylinder circumvents the vacuum-creating means, and wherein pneumatic flow from the interior of the cylinder to the pneumatic port is forced through the vacuum-creating means.

22. The self-vacuum arrangement of claim 21, wherein the vacuum-creating means is a Venturi device.

23. The self-vacuum arrangement of claim 21, wherein pneumatic flow from the interior of the cylinder is caused by movement of a piston within the interior of the cylinder.

24. The self-vacuum arrangement of claim 21, wherein the vacuum-creating means draws contaminants from the void toward the pneumatic port.

25. A pneumatic actuator comprising the self-vacuum arrangement of claim 21.

26. A head cap for a pneumatic actuator, the head cap comprising the self-vacuum arrangement of claim 21.

27. A vacuum-generating cartridge attachable to a pneumatic actuator, the vacuum-generating cartridge comprising the self-vacuum arrangement of claim 21.

28. A self-vacuum arrangement, comprising:

a Venturi device having a first port, a second port, and a central tap;

a first check valve having a first port operably coupled with the central tap of the Venturi device and configured to prevent pneumatic flow from the central tap through the first check valve;

a second check valve having a first port operably coupled with the first port of the Venturi device and a second port operably coupled with the second port of the Venturi device, wherein the second check valve prevents pneumatic flow through the second check valve from the first port of the second check valve to the second port of the second check valve;

the Venturi device is configured to draw pneumatic flow into the central tap of the Venturi device through the first check valve when pneumatic flow occurs through the Venturi device from the first port of the Venturi device to the second port of the Venturi device; and the first port of the Venturi device and the first port of the second check valve are pneumatically coupled with an interior of a cylinder of a pneumatic actuator, the second port of the Venturi device and the second port of the second check valve are pneumatically coupled with a pneumatic port of the pneumatic actuator, and a second port of the fast check valve is pneumatically coupled with a void associated with the pneumatic actuator.

29. The self-vacuum, arrangement of claim 28, wherein the Venturi device, the first check valve, and the second check valve are located within a head cap of the pneumatic actuator.

30. The self-vacuum arrangement of claim 28, wherein the Venturi device and the first check valve are located external to the pneumatic actuator.

31. The self-vacuum arrangement of claim 28, wherein the void is a space between a rod seal and a rod wiper of the pneumatic actuator.

32. The self-vacuum arrangement of claim 28, wherein the void is a space between a first seal and a second seal of a pneumatic coupler attached to the pneumatic actuator.

33. The self-vacuum arrangement of claim 28, wherein pneumatic flow occurs through the Venturi device from the first port of the Venturi device to the second port of the Venturi device when a piston moves within the interior of the cylinder of the pneumatic actuator.

34. The self-vacuum arrangement of claim 28, wherein the first and second check valves comprise ball valves.

* * * * *